US011670828B1

(12) United States Patent
Davies et al.

(10) Patent No.: US 11,670,828 B1
(45) Date of Patent: Jun. 6, 2023

(54) DIELECTRIC AND THIN FILM FLOATING METAL STACKING FOR EMBEDDED TUNABLE FILTERING OF HIGH FREQUENCY SIGNALS

(71) Applicant: Rockwell Collins, Inc., Cedar Rapids, IA (US)

(72) Inventors: Orion Davies, Cedar Rapids, IA (US); Altin E. Pelteku, Severna Park, MD (US); Jonathan A. Lovseth, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 163 days.

(21) Appl. No.: 17/241,820

(22) Filed: Apr. 27, 2021

(51) Int. Cl.
*H01P 1/203* (2006.01)
*H01P 1/202* (2006.01)

(52) U.S. Cl.
CPC ..... *H01P 1/203* (2013.01); *H01P 1/202* (2013.01)

(58) Field of Classification Search
CPC ..... H01P 1/203; H01P 1/205; H01P 1/202; H01P 1/20; H01P 1/201
See application file for complete search history.

(56) References Cited

U.S. PATENT DOCUMENTS 5,382,931 A 1/1995 Piloto et al.
5,943,005 A 8/1999 Tanizaki et al.
6,535,083 B1 3/2003 Hageman et al.
2010/0109807 A1* 5/2010 Iwanami ..... H01P 1/203 333/185
2018/0226714 A1 8/2018 Apostolos et al.
2020/0313265 A1 10/2020 Pivit et al.

FOREIGN PATENT DOCUMENTS

CN 2243719 12/1996
CN 103401047 B 5/2015
CN 107134614 B 5/2019
CN 111668581 A 9/2020
CN 111755789 A 10/2020
JP 1987086905 A 4/1987
JP 1989073802 A 3/1989
KR 101442220 B1 9/2014

OTHER PUBLICATIONS

Zhou et a. CN103401047 Full Translation, May 20, 2015.*

* cited by examiner

*Primary Examiner* — Stephen E. Jones
(74) *Attorney, Agent, or Firm* — Suiter Swantz pc llo

(57) ABSTRACT

A filter apparatus is disclosed. The filter apparatus may include a plurality of dielectric layers. The plurality of dielectric layers may include one or more first dielectric layers formed of a first dielectric material and one or more second dielectric layers formed of a second dielectric material. The second dielectric material of the one or more second dielectric layers being different than the first dielectric material of the one or more first dielectric layers. The filter apparatus may further include one or more thin-film metal layers arranged between at least one dielectric layer of the plurality of dielectric layers and an additional dielectric layer of the plurality of dielectric layers.

13 Claims, 10 Drawing Sheets

DIELECTRIC AND THIN FILM FLOATING METAL STACKING FOR EMBEDDED TUNABLE FILTERING OF HIGH FREQUENCY SIGNALS

BACKGROUND

Design goals for Radio Frequency (RF) system embodiments (e.g., circuit boards, microsystem packages, or the like) are in continual need of finding new ways to improve insertion loss for specified frequency bands while maximizing rejection of specific frequencies.

SUMMARY

A filter apparatus is disclosed, in accordance with one or more embodiments of the disclosure. In one embodiment, the apparatus includes a plurality of dielectric layers including one or more first dielectric layers formed of a first dielectric material and one or more second dielectric layers formed of a second dielectric material, the second dielectric material of the one or more second dielectric layers being different than the first dielectric material of the one or more first dielectric layers. In another embodiment, the apparatus includes one or more thin-film metal layers arranged between at least one dielectric layer of the plurality of dielectric layers and an additional dielectric layer of the plurality of dielectric layers.

In some embodiments, the apparatus may further include one or more piezoelectric plates configured to apply a select amount of pressure to the plurality of dielectric layers to cause at least one of the one or more first dielectric layers or the one or more second dielectric layers to compress in response to a control voltage, a physical thickness of the at least one of the one or more first dielectric layers or the one or more second dielectric layers may be configured to change in response to the applied pressure of the one or more piezoelectric plates.

In some embodiments, the first dielectric material of the one or more first dielectric layers may be a first piezoelectric material, the first piezoelectric material may be configured to adjust a physical thickness of the one or more first dielectric layers upon application of a control voltage.

In some embodiments, the second dielectric material of the one or more second dielectric layers may be a second piezoelectric material, the second piezoelectric material may be configured to adjust a physical thickness of the one or more second dielectric layers upon application of a control voltage.

In some embodiments, the one or more thin-film metal layers may be deposited on at least one of the one or more first dielectric layers or the one or more second dielectric layers.

In some embodiments, the apparatus may further include a transmission line configured to provide an input signal to the filter apparatus.

In some embodiments, the apparatus may further include a first set of a plurality of dielectric layers; an additional set of a plurality of dielectric layers, each of the first set of the plurality of dielectric layers and the additional set of the plurality of dielectric layers including one or more first dielectric layers formed of a first dielectric material and one or more second dielectric layers formed of a second dielectric material, the second dielectric material of the one or more second dielectric layers being different than the first dielectric material of the one or more first dielectric layers; a first set of one or more thin-film metal layers, the one or more thin-film metal layers arranged between at least one dielectric layer of the first set of the plurality of dielectric layers and an additional dielectric layer of the first set of the plurality of dielectric layers; and an additional set of one or more thin-film metal layers, the one or more thin-film metal layers arranged between at least one dielectric layer of the additional set of the plurality of dielectric layers and an additional dielectric layer of the additional set of the plurality of dielectric layers, the first set of the plurality of dielectric layers and the first set of the one or more thin-film metal layers positioned above the transmission line, the additional set of the plurality of dielectric layers and the additional set of the one or more thin-film metal layers positioned below the transmission line.

In some embodiments, the plurality of dielectric layers and the one or more thin-film metal layers may encircle the transmission line.

In some embodiments, the plurality of dielectric layers and the one or more thin-film metal layers may be positioned below the transmission line.

In some embodiments, the input signal may be a millimeter wavelength frequency input signal.

A method is disclosed, in accordance with one or more embodiments of the present disclosure. In one embodiment, the method includes receiving one or more input signals from one or more input sources via one or more signal transmission lines. In another embodiment, the method include filtering the received one or more input signals using a filter apparatus. In another embodiment, the filter apparatus includes a plurality of dielectric layers, the plurality of dielectric layers including one or more first dielectric layers formed of a first dielectric material and one or more second dielectric layers formed of a second dielectric material, the second dielectric material of the one or more second dielectric layers being different than the first dielectric material of the one or more first dielectric layers. In another embodiment, the filter apparatus includes one or more thin-film metal layers, the one or more thin-film metal layers arranged between at least one dielectric layer of the plurality of dielectric layers and an additional dielectric layer of the plurality of dielectric layers. In another embodiment, at least one of the plurality of dielectric layers or the one or more thin-film metal layers configured to allow a portion of the received one or more input signals in if the received one or more input signals are less than a predetermined threshold signal, or reject a portion of the received one or more input signals in if the received one or more input signals are greater than the predetermined threshold signal.

In some embodiments, the filter apparatus may further include one or more piezoelectric plates.

In some embodiments, the method may further comprise adjusting a physical thickness of the filter apparatus to tune a rejection notch, the one or more piezoelectric plates configured to apply a select amount of pressure to the plurality of dielectric layers to cause at least one of the one or more first dielectric layers or the one or more second dielectric layers to compress in response to a control voltage, a physical thickness of the at least one of the one or more first dielectric layers or the one or more second dielectric layers configured to change in response to the applied pressure of the one or more piezoelectric plates.

In some embodiments, at least of the first dielectric material of the one or more first dielectric layers or the second dielectric material of the one or more second dielectric layers may be a piezoelectric material.

In some embodiments, the method may further comprise adjusting a physical thickness of the filter apparatus to tune a rejection notch, the piezoelectric material configured to adjust the physical thickness of at least one of the one or more first dielectric layers or the one or more second dielectric layers upon application of a control voltage.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are examples and explanatory only and are not necessarily restrictive of the subject matter claimed.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the disclosure are disclosed in the following detailed description and the accompanying drawings. The drawings are not necessarily to scale. In general, operations of disclosed processes may be performed in an arbitrary order, unless otherwise provided in the claims. In the drawings:

DETAILED DESCRIPTION OF THE INVENTION

Figure 1A:
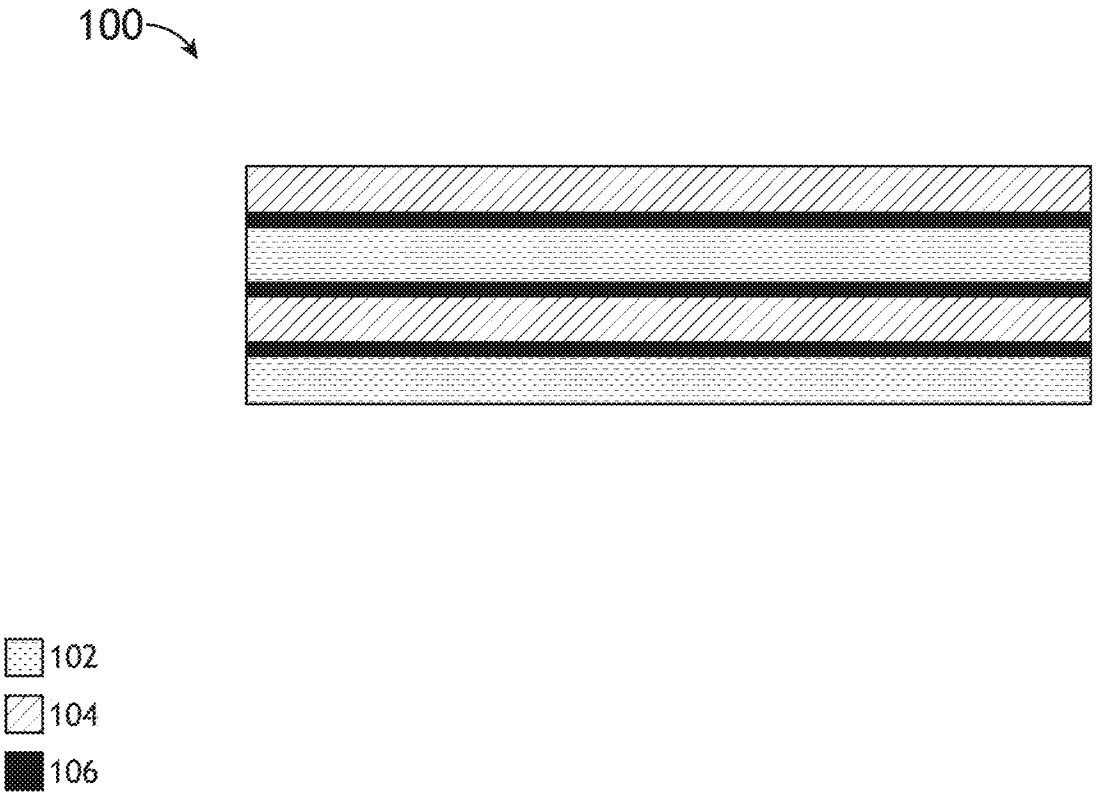
FIG. 1A illustrates a simplified schematic view of a filter apparatus including two alternating dielectric layer pairs with thin film metallization in between each layer, in accordance with one or more embodiments of the disclosure.

Reference will now be made in detail to the subject matter disclosed, which is illustrated in the accompanying drawings.

Before explaining one or more embodiments of the disclosure in detail, it is to be understood the embodiments are not limited in their application to the details of construction and the arrangement of the components or steps or methodologies set forth in the following description or illustrated in the drawings. In the following detailed description of embodiments, numerous specific details may be set forth in order to provide a more thorough understanding of the disclosure. However, it will be apparent to one of ordinary skill in the art having the benefit of the instant disclosure the embodiments disclosed herein may be practiced without some of these specific details. In other instances, well-known features may not be described in detail to avoid unnecessarily complicating the instant disclosure.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only and should not be construed to limit the disclosure in any way unless expressly stated to the contrary.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of "a" or "an" may be employed to describe elements and components of embodiments disclosed herein. This is done merely for convenience and "a" and "an" are intended to include "one" or "at least one," and the singular also includes the plural unless it is obvious that it is meant otherwise.

Finally, as used herein any reference to "one embodiment" or "some embodiments" means that a particular element, feature, structure, or characteristic described in connection with the embodiment is included in at least one embodiment disclosed herein. The appearances of the phrase "in some embodiments" in various places in the specification are not necessarily all referring to the same embodiment, and embodiments may include one or more of the features expressly described or inherently present herein, or any combination of or sub-combination of two or more such features, along with any other features which may not necessarily be expressly described or inherently present in the instant disclosure.

Design goals for Radio Frequency (RF) system embodiments (e.g., circuit boards, microsystem packages, or the like) are in continual need of finding new ways to improve insertion loss for specified frequency bands while maximizing rejection of specific frequencies. As radio technology progresses into millimeter wave frequencies (e.g., Ka-band and up) the analogues between RF domain and optical domain electromagnetic frequencies become increasingly relevant. Current state of the art bandpass filtering and band rejection filtering technology relies heavily on active processing of signals to achieve these design goals through novel integrated circuits and digital signal processing. Integrated circuit technology can also utilize embedded passives through clever design arrangement of materials and geometry, where the electrical property (capacitance, resistance, or inductance) is realized through the material composition and geometry of the transmission medium itself instead of a discrete, lumped-element component.

Broadly, embodiments of the present disclosure are directed to a filter apparatus including alternating layers of dielectric material, where a thin-film layer of metal is deposited between each alternating dielectric layer. In this regard, the filter apparatus may be configured to enhance the image rejection after downconverting (or upconverting) the radio frequency (RF) signal to further attenuate the image product using the material composition and geometry of the filter apparatus. Additionally, in some embodiments, a piezoelectric plate may be used to apply pressure to the filter apparatus to cause the thickness of the alternating dielectric layers to change. In this regard, when pressure is applied, the location of resonant notches in the frequency domain may be shifted (also referred to as "tuning") in response to the change in physical thickness of the dielectric layers. Additionally, in some embodiments, the alternating dielectric materials are themselves piezoelectric in nature and may be configured to undergo changes in layer thickness at the application of a direct current (DC) voltage. Additionally, in some embodiments, a feedback control loop is established to adjust the applied voltage in response to undesired thickness changes from vibration or temperature and maintain the desired frequency response.

FIG. 1A is a simplified cross-sectional view of the filter apparatus 100, in accordance with one or more embodiments of the disclosure.

The apparatus 100 may include a plurality of dielectric layers. The plurality of dielectric layers may include one or more first dielectric layers 102 and one or more second dielectric layers 104. For example, as shown in FIGS. 1A-1E, the apparatus 100 may include a plurality of first dielectric layers 102 and a plurality of second dielectric layers 104 in an alternating-stacked configuration (e.g., the first layer 102 stacked on the second layer 104).

The first dielectric layer 102 may be formed of a first dielectric material and the second dielectric layer 104 may be formed of a second dielectric material, the first dielectric material being different than the second dielectric material. For example, the first dielectric material may have a first permittivity value $\varepsilon_1$ and the second dielectric material may have a second permittivity value $\varepsilon_2$, where the first permittivity value $\varepsilon_1$ is different than the second permittivity value $\varepsilon_2$. In a non-limiting example, the first permittivity value $\varepsilon_1$ for the first dielectric material may be 3.2 and the second permittivity value $\varepsilon_2$ for the second dielectric material may be 3.66.

The plurality of dielectric layers (e.g., the first dielectric layers 102 and the second dielectric layers 104) may be formed of any dielectric material know in the art including, but not limited to, ceramic, plastic, mica, glass, or the like.

Although FIG. 1A-1E illustrates a specific configuration of dielectric layers 102, 104 (e.g., thickness, number, or the like), it is noted that the filter apparatus 100 may include any number of layers 104, 106 with any thickness.

The apparatus 100 may include one or more thin-film metal layers 106. In some embodiments, as shown in FIGS. 1A-1E, the one or more thin-film metal layers 106 may be arranged between the one or more first dielectric layers 102 and the one or more second dielectric layers 104. For example, the one or more thin-film metal layers 106 may be arranged between a first dielectric layer 102 of the one or more first dielectric layers and an additional dielectric layer 104 of the one or more second dielectric layers. In one instance, the one or more thin-film metal layers 106 may be arranged between each first dielectric layer 102 and each second dielectric layer 104 (e.g., between each layer of the plurality of dielectric layers). In another instance, the one or more thin-film metal layers 106 may be arranged between every N number of layers.

In some embodiments, the thin-film metal layer 106 may be vapor deposited, sputtered, etched, grown, or otherwise fabricated on a surface of at least one of the first dielectric layer 102 or the second dielectric layer 104 of the plurality of dielectric layers. It is noted that the thin-film metal layer 106 may be deposited on the surface of the at least one of the first dielectric layer 102 or the second dielectric layer 104 using any technique known in the art including, but not limited to, sputtering, lithography, or the like.

Although FIG. 1A-1E illustrates a specific configuration of thin-film metal layers 106 (e.g., thickness, number, or the like), it is noted that the filter apparatus 100 may include any number of thin-film metal layers 106 with any thickness.

Figure 1B:
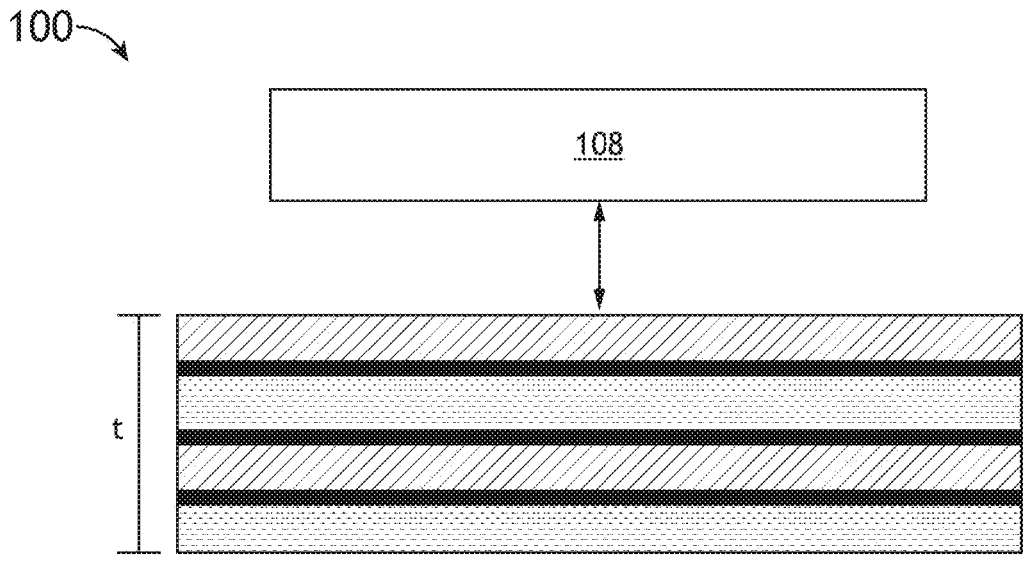
FIG. 1B illustrates a simplified schematic view of the filter apparatus including one or more piezoelectric plates, in accordance with one or more embodiments of the disclosure.
Figure 1C:
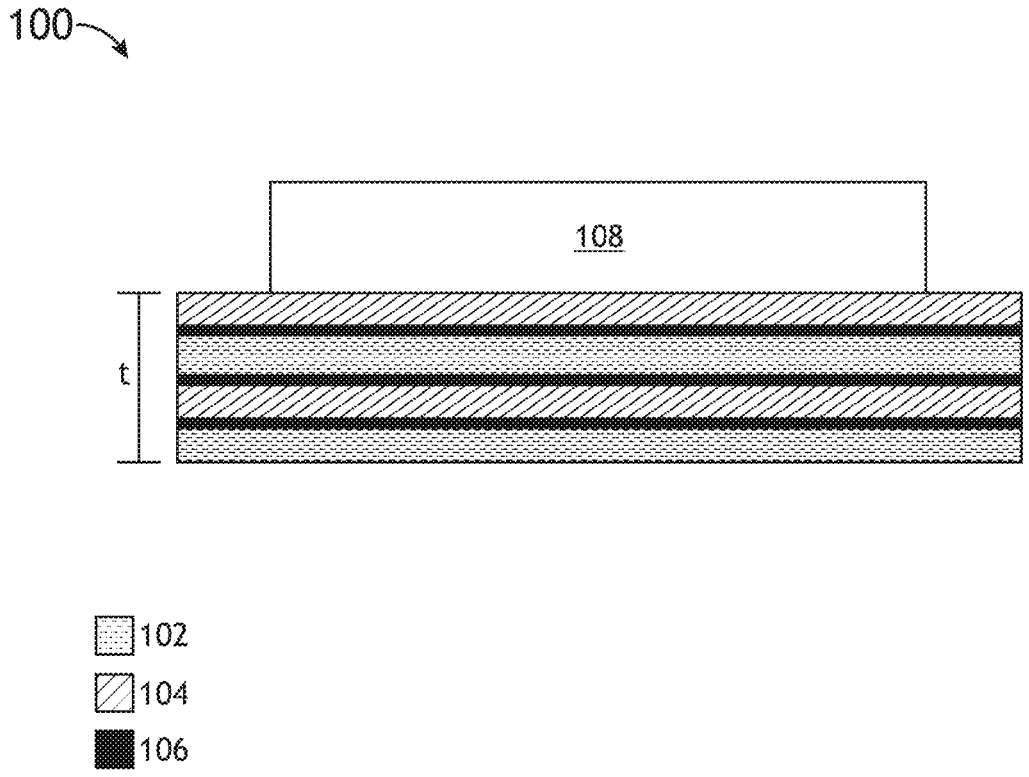
FIG. 1C illustrates a simplified schematic view of the filter apparatus including one or more piezoelectric plates, in accordance with one or more embodiments of the disclosure.

FIGS. 1B-1C illustrate the filter apparatus 100 including one or more piezoelectric plates 108, in accordance with one or more embodiments of the disclosure.

The apparatus 100 may include one or more piezoelectric plates 108 (or piezoelectric chips) configured to apply pressure to the plurality of dielectric layers. It is noted that the apparatus 100 may include any type of piezoelectric plate (or chip) known in the art suitable for compressing the plurality of dielectric layers. For example, the apparatus 100 may include a rectangular piezoelectric chip. By way of another example, the apparatus 100 may include a piezoelectric stack. By way of another example, the apparatus 100 may include a ring piezoelectric chip.

Figure 4A:
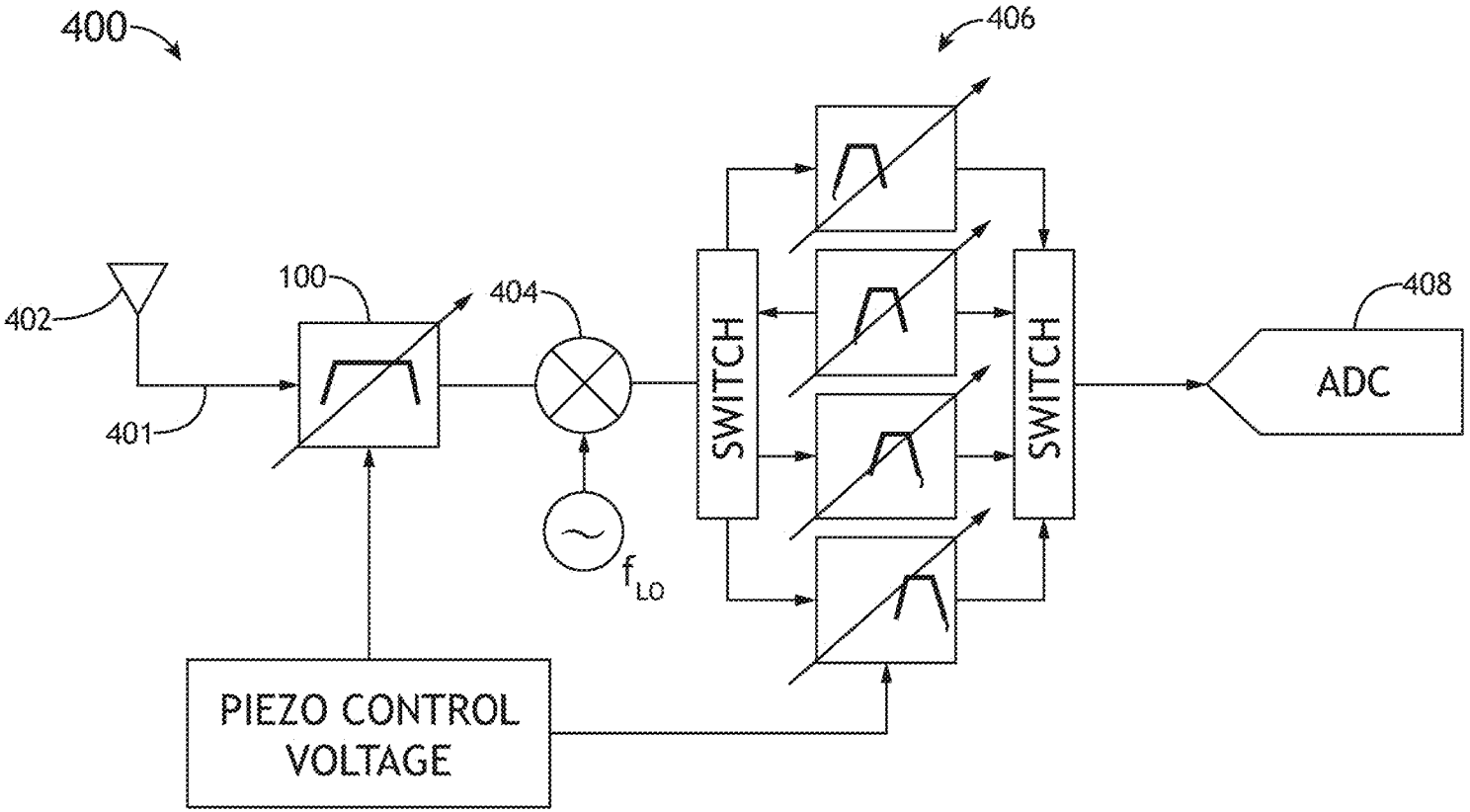
FIG. 4A illustrates simplified schematic view of a system including the filter apparatus, in accordance with one or more embodiments of the disclosure.
Figure 4B:
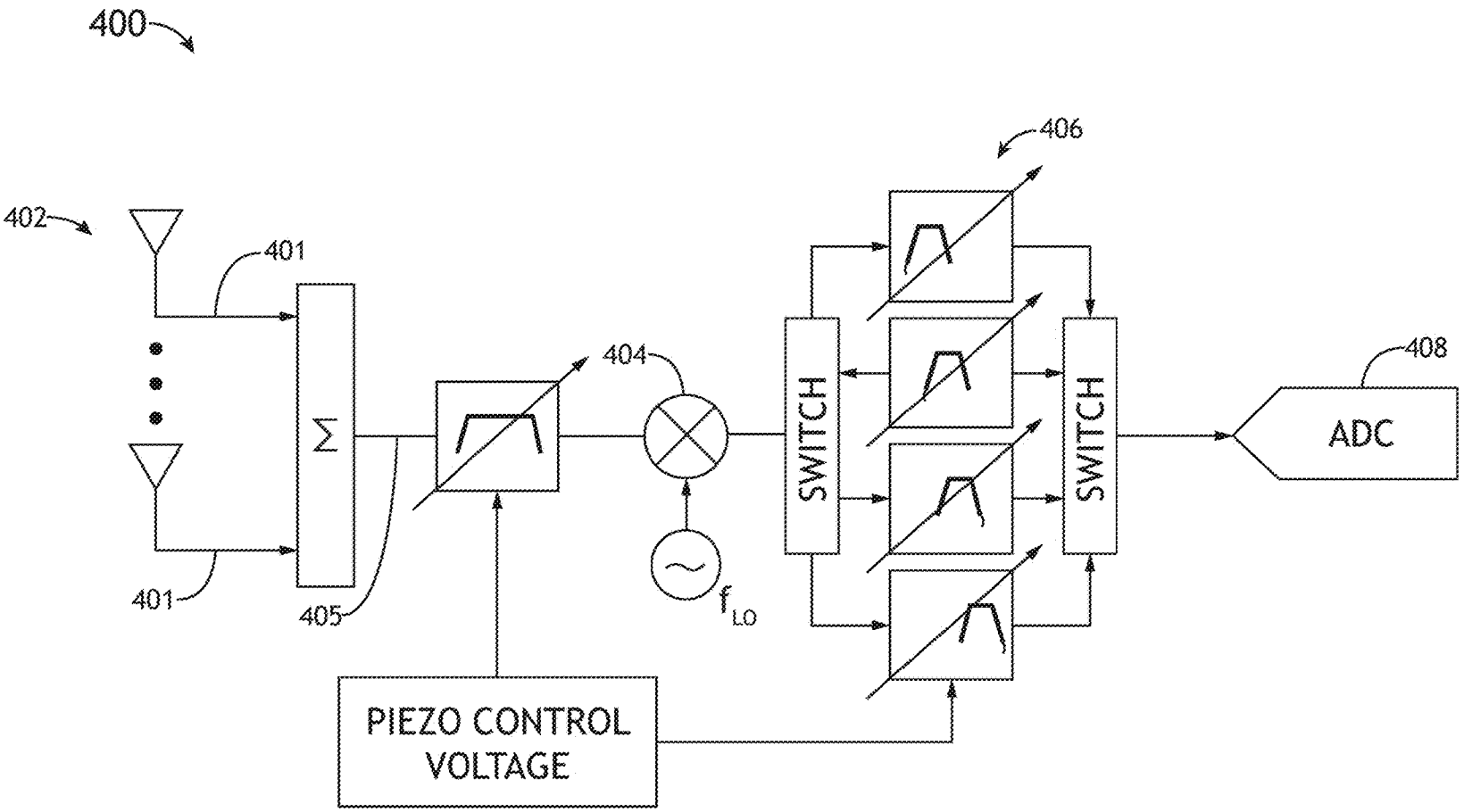
FIG. 4B illustrates simplified schematic view of a system including the filter apparatus, in accordance with one or more embodiments of the disclosure.

The one or more piezoelectric plates 108 may be configured to apply pressure to the plurality of dielectric layers to cause the layers to compress. For instance, as shown in FIGS. 1B-1C, the physical thickness t of the plurality of dielectric layers may be adjusted in response to applying pressure with the one or more piezoelectric plates 108. In this regard, the physical thickness t of the dielectric layers (e.g., the first layer, the second layer, or a combination of thereof) may be adjusted in response to applying pressure with the one or more piezoelectric plates 108 through application of a control voltage, as shown in FIGS. 4A-4B.

The one or more piezoelectric plates 108 may be configured to apply a predetermined amount of pressure to the plurality of dielectric layers 102 to control an amount of frequency tuning in response to one or more voltage signals. For example, the one or more piezoelectric plates 108 may be configured to translate a select distance in the y-axis based on an amount of drive voltage received. In this regard, the tuning range (e.g., tuning range 306) may be controlled based on the amount of drive voltage provided to the one or more piezoelectric plates 108, such that the distance that the piezoelectric plate translates in the y-axis may be controlled based on the amount of drive voltage received from a control voltage source, as shown in FIGS. 4A-4B.

Figure 1D:
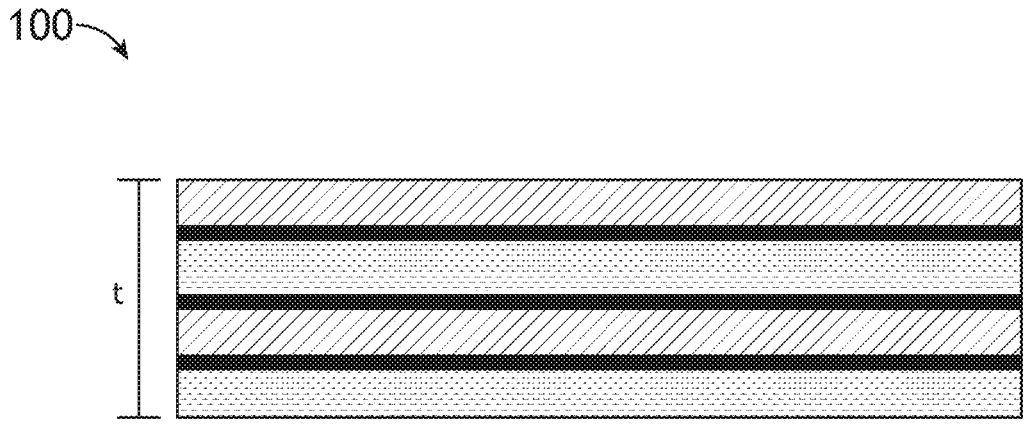
FIG. 1D illustrates a simplified schematic view of the filter apparatus, in accordance with one or more embodiments of the disclosure.
Figure 1E:
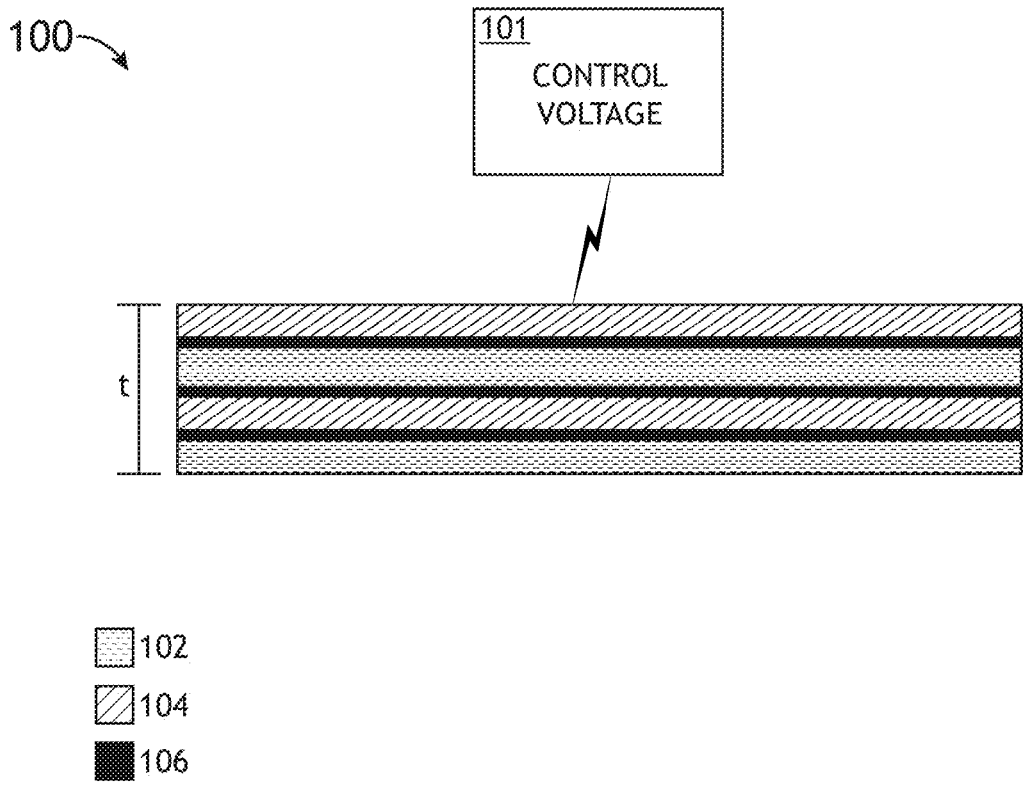
FIG. 1E illustrates a simplified schematic view of the filter apparatus, in accordance with one or more embodiments of the disclosure.

FIGS. 1D-1E illustrate the filter apparatus 100 without piezoelectric plates 108, in accordance with one or more embodiments of the disclosure.

The plurality of dielectric layers may be configured to be compressed. For example, at least one of the first dielectric layer 102 or the second dielectric layer 104 of the plurality of dielectric layers may be formed of a piezoelectric material configured to be compressed. In one instance, the first dielectric layer 102 may be formed of a first piezoelectric material and the second dielectric layer 104 may be formed of a second piezoelectric material, the first piezoelectric material being of a different dielectric constant than the second piezoelectric material. In another instance, the first dielectric layer 102 may be formed of a piezoelectric material and the second dielectric layer 104 may be formed of a non-piezoelectric material. In another instance, the first dielectric layer 102 may be formed of a non-piezoelectric material and the second dielectric layer 104 may be formed of a piezoelectric material.

The dielectric layers 102, 104 including piezoelectric materials may be compressed by applying a control voltage 101. In this regard, when the control voltage is applied, a physical thickness t of the dielectric layers 102, 104 may be adjusted without the need for piezoelectric plates.

By way of another example, the layer thicknesses can be tuned mechanically using compression fitting hardware and specified torque.

Figure 2A:
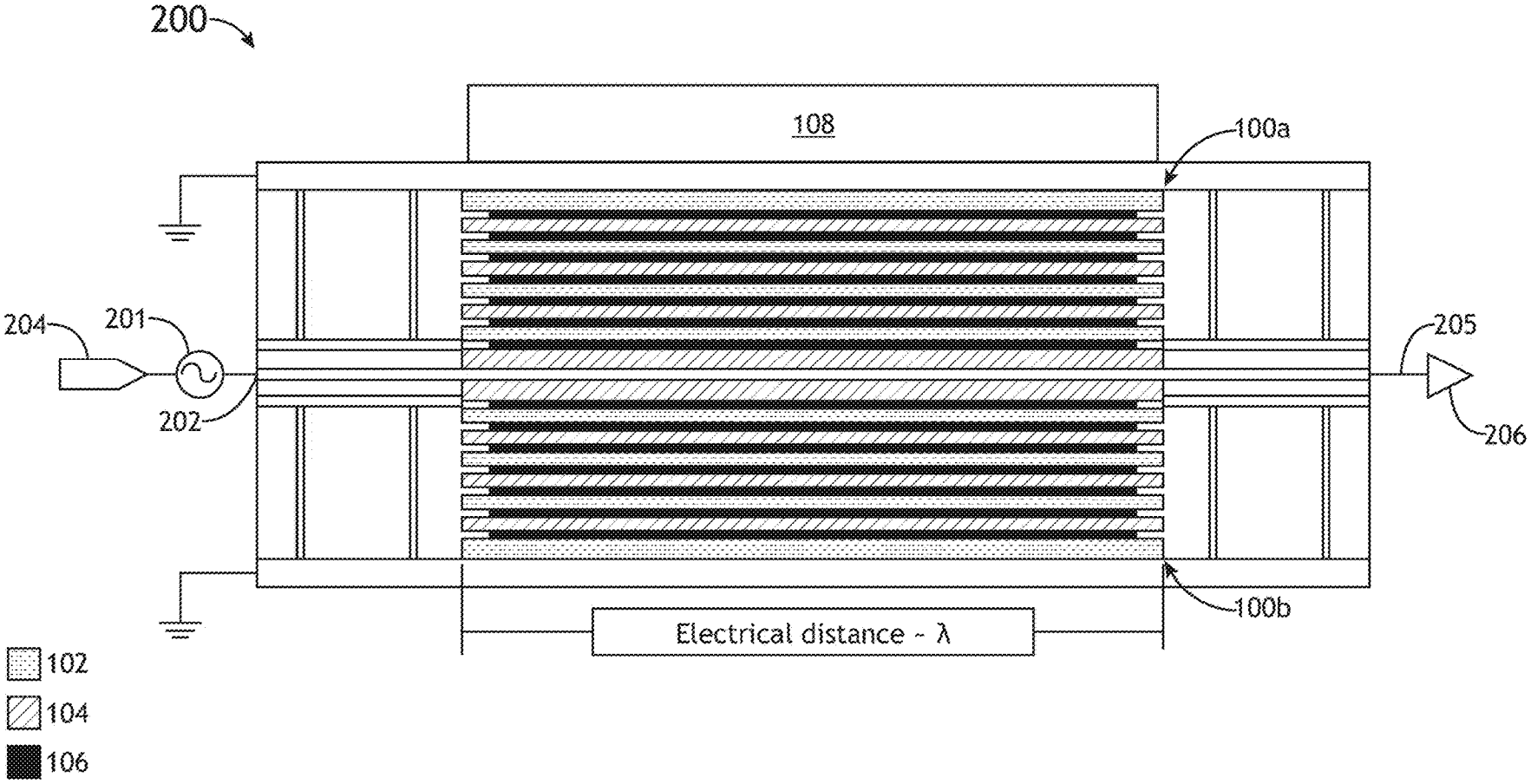
FIG. 2A illustrates a simplified schematic view of a unit cell of the filter apparatus in a stripline configuration, for a section of a package substrate or printed circuit board, in accordance with one or more embodiments of the disclosure.
Figure 2B:
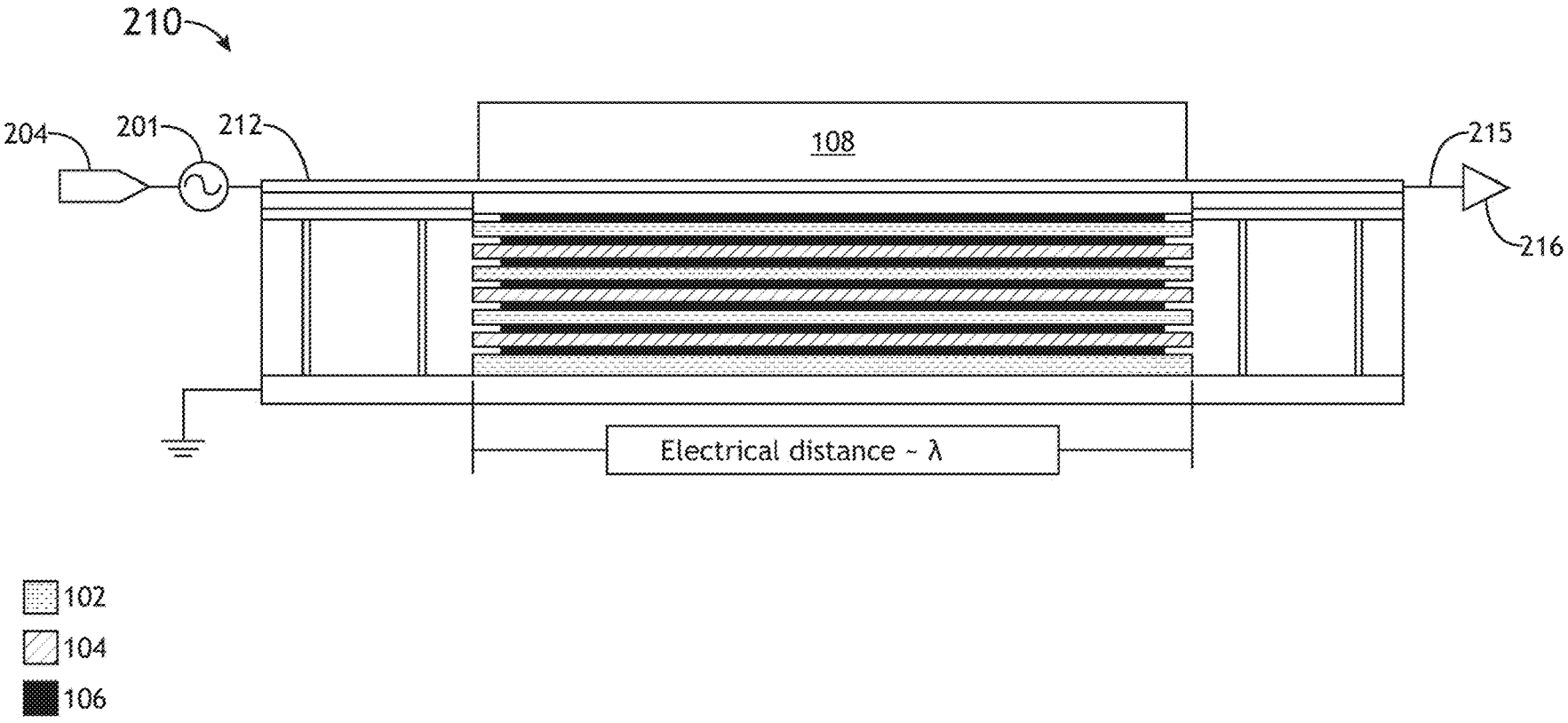
FIG. 2B illustrates a simplified schematic view of a unit cell of the filter apparatus in a microstrip configuration, for a section of a package substrate or printed circuit board, in accordance with one or more embodiments of the disclosure.

FIGS. 2A-2B illustrates a simplified schematic view of the filter apparatus 100, in accordance with one or more embodiments of the disclosure. In particular, FIG. 2A is a simplified schematic view of a unit cell of the filter apparatus 100 in a stripline configuration 200 for a section of a package substrate or printed circuit board. In particular, FIG. 2B is a simplified schematic view of a unit cell of the filter apparatus 100 in a microstrip configuration 210 for a section of a package substrate or printed circuit board. For purposes of the present disclosure, it is noted that a "unit cell" for the filter apparatus 100 may be defined as having an electrical length on the order of a single wavelength at a predetermined bandpass frequency.

As shown in FIG. 2A, in the case of a stripline configuration 200, one or more filter apparatuses 100 may be positioned above and below a transmission line 202. For example, a first filter apparatus 100*a* may be positioned above the transmission line 202 and an additional filter apparatus 100*b* may be positioned below the transmission line 202. For instance, a first thin-film metal layer 106 may be arranged on the bottom of the first dielectric layer underneath the transmission line 202 and a second thin-film metal layer 106 may be arranged on the top of the first dielectric layer above the transmission line 202 with subsequent layers of thin film metal between each dielectric layer, except for the dielectric layers that contact the ground planes above and below the stripline.

In this example configuration 200, the one or more filter apparatuses 100*a*, 100*b* are configured to receive an input signal 201 from an input source 204. For example, the one or more filter apparatuses 100*a*, 100*b* may be configured to receive a millimeter wavelength frequency signal from a millimeter wavelength frequency input source 204 via the transmission line 202. After the filter apparatuses filter the signal 201, a filtered signal 205 may be provided to a signal destination 206. For example, the filtered signal 205 may be provided to an integrated circuit. In this regard, the apparatus 100 may be embedded into the stackup of a printed circuit board such that the signal must pass through a section of transmission line encompassed by the apparatus before the signal reaches its destination on the circuit board.

As shown in FIG. 2B, in the case of a microstrip configuration 210, the filter apparatus 100 may be positioned below a transmission line 212. For example, a first thin-film metal layer 106 may be arranged between the microstrip conductor and the second dielectric layer, with subsequent layers of thin film metal between each dielectric layer except for the layer that is on top of the ground plane. In this regard, the apparatus 100 may be embedded into the periphery of an integrated circuit package substrate such that the signal external to the package must pass through a section of transmission line encompassed by the apparatus before the signal transitions into the integrated circuit itself.

In this example configuration 210, the filter apparatus 100 is configured to receive an input signal 211 from an input source 214. For example, the filter apparatus 100 may be configured to receive a millimeter wavelength frequency signal from a millimeter wavelength frequency input source 214 via the transmission line 212. After the filter apparatus filters the signal 211, a filtered signal 215 may be provided to a signal destination 216. For example, the filtered signal 215 may be provided to an integrated circuit.

Figure 2C:
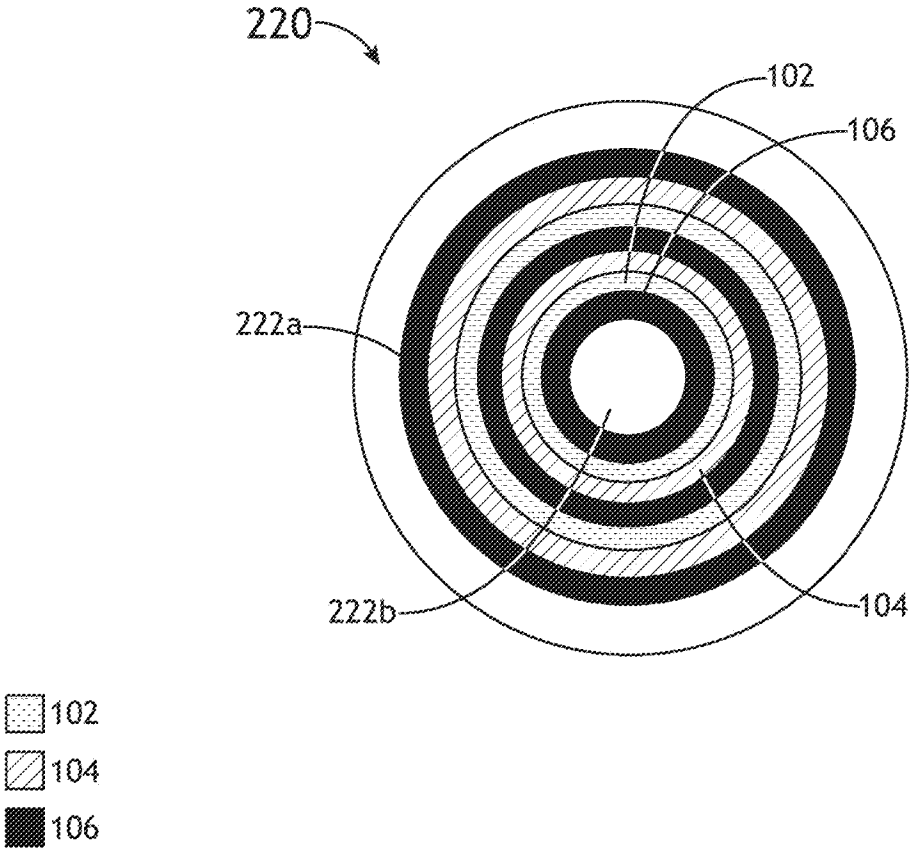
FIG. 2C illustrates a simplified schematic view of a unit cell of the filter apparatus in a coaxial configuration, for a section of a package substrate or printed circuit board, in accordance with one or more embodiments of the disclosure.

As shown in FIG. 2C, in the case of a coaxial configuration 220, the filter apparatus 100 may include rings of dielectric/piezoelectric material 102, 104 with rings of thin-film metal 106 encircling a center transmission line 222*b*. For example, the apparatus 100 may be comprised of a coaxial waveguide with the layer pairs fabricated radially outward, in between the center conductor 222*b* and the outer conductor 222*a*.

Figure 3:
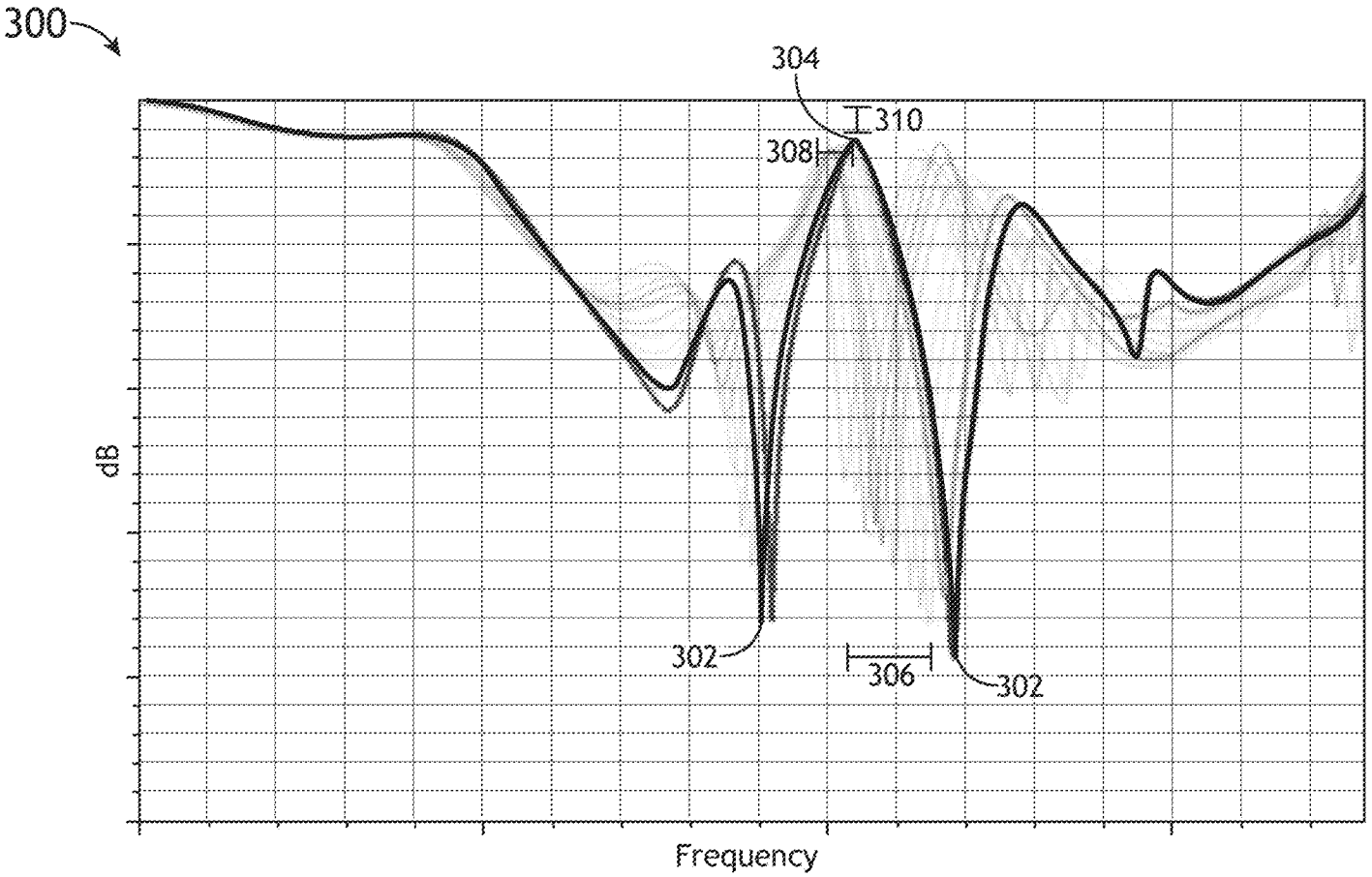
FIG. 3 illustrates a plot of tunable frequency responses of the filter apparatus, in accordance with one or more embodiments of the disclosure.

FIG. 3 is a plot 300 of tunable frequency responses of the filter apparatus 100, in accordance with one or more embodiments of the disclosure.

As discussed previously herein, the one or more piezoelectric plates 108 may be configured to change the physical thickness t of the filter apparatus 100 by applying a select amount of pressure to the dielectric layers 102, 104. The plot 300 depicts a bandpass frequency response with a rejection notch 302 on either side of the passband 304, which may be tunable using the one or more piezoelectric plates 108. As shown in FIG. 3, the rejection notch 302 may be tunable over a tuning range 306 in response to the change in physical thickness t of the filter apparatus 100. In a non-limiting example, the rejection notch 302 may be tunable over approximately 3.5 GHz for 1000 μm in total thickness change.

As shown in FIG. 3, the passband 304 may be tunable over a tuning range 308 in response to the change in physical thickness t of the filter apparatus. It is noted that the tuning range 308 of the passband 304 may be narrower than the tuning range 306 for the rejection notch 302 (e.g., there is less movement in the x-axis near the passband 304 than in the x-axis near the rejection notch 302).

It is noted that the filter apparatus 100 may have a relatively small insertion loss. For example, as shown in FIG. 3, the filter apparatus 100 may have an insertion loss 310 that is relatively close the top axis of the plot 300. For instance, the filter apparatus 100 may have an insertion loss 310 of approximately 3 dB.

Further, it is noted that the frequency response may be dependent on the material properties, layer thicknesses, presence of thin film floating metal between layers, number of layer pairs, the area of floating metal film relative to area of transmission line, and the like. FIG. 3 depicts the insertion loss plots for ten bandpass filter responses using ten pairs of alternating dielectric layers beginning with 400 micron layer thicknesses and 5 micron thick floating gold film between each dielectric layer, and reducing dielectric thicknesses by 10 microns per response. Response trace 300 shows the simulated response for 300 micron layer thicknesses. In this example, the bandpass is designed with 1 GHz tuning range 308 from 20 GHz to 21 GHz passband 304. At 21 GHz passband 304, the insertion loss 310 for the bandpass is approximately −3 dB. Across the tuning range 306, the rejection of the bandpass covers approximately 3.5 GHz tuning range 306, with rejection nulls 302 of approximately −40 dB deep.

FIGS. 4A-4B illustrate an exemplary system 400 including one or more filter apparatuses 100, in accordance with one or more embodiments of the disclosure. The filter apparatus 100 may be configured to enhance the image rejection in the system 400 after downconverting (or upconverting) the radio frequency (RF) signal 401 to further attenuate the image product using the material composition and geometry of the filter apparatus 100.

The system 400 may be configured to receive one or more RF signals 401 from one or more RF input sources 402. The one or more RF input sources 402 may include any type of RF input source known in the art including, but not limited to, an antenna (shown in FIG. 4A), an antenna array (shown in FIG. 4B), or the like.

In some embodiments, when the input sources 402 include an antenna array 402, as shown in FIG. 4B, the signals 401 may be adjusted and combined into a signal 405 that is provided to the filter apparatus 100.

The system 400 may include a filter apparatus 100 configured to receive an input signal 401, 405. For example, the filter apparatus 100 may be configured to receive a millimeter wavelength frequency signal. In some embodiments, as shown in FIGS. 4A-4B, the filter apparatus 100 may be placed near the one or more RF input sources 402.

The system 400 may include one or more mixers 404 (e.g., downconverting mixers or upconverting mixers). The filter apparatus 100 may be configured to enhance the image rejection of the one or more mixers 404.

In some embodiments, as shown in FIGS. 4A-4B, the system 400 may include an array of additional filter apparatuses 406 (e.g., one or more filter apparatuses 100). In this embodiment, the array of additional filter apparatuses 406 may be configured to provide additional filtering during the intermediate frequency (IF) stage before the input to an analog to digital converter (ADC) 408.

It is noted that any number of filter apparatuses 100 may be utilized within a packaged substrate system at any location within the system. FIGS. 4A-4B are provided merely for illustrative purposes and shall not be construed as limiting the scope of the present disclosure.

Figure 5:
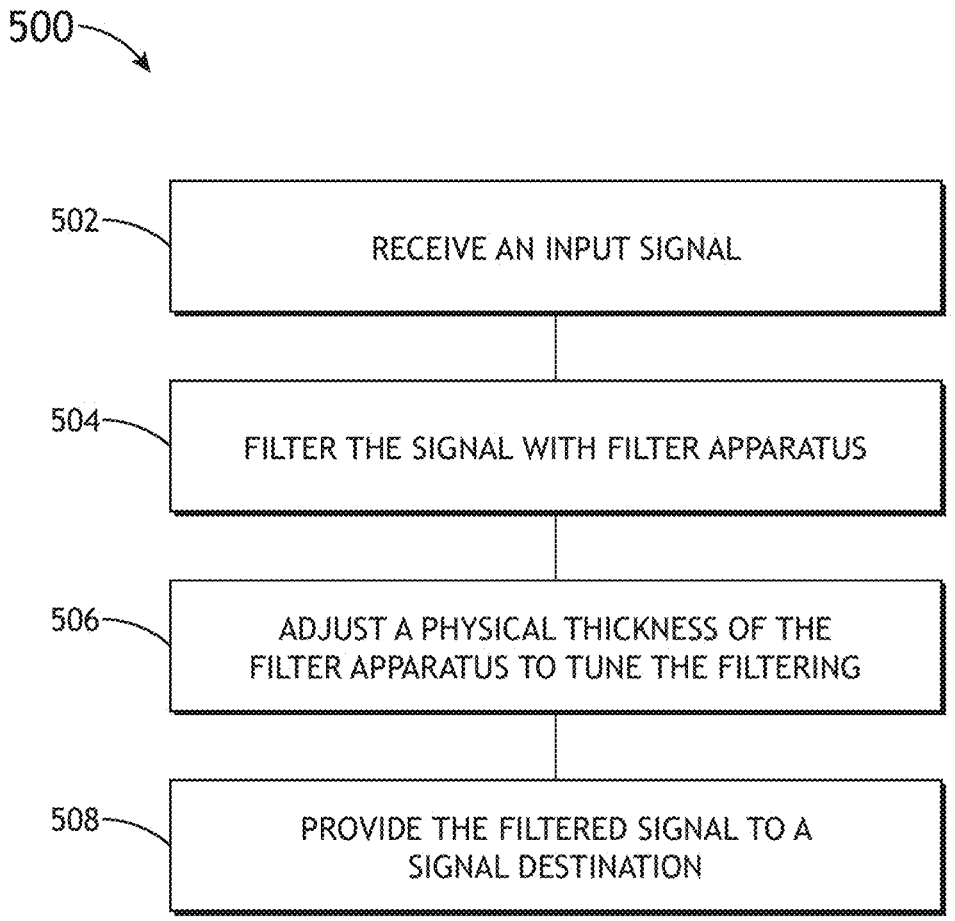
FIG. 5 illustrates a flowchart depicting a method or process for the filter apparatus, in accordance with one or more embodiments of the disclosure.

FIG. 5 illustrates a flowchart of a method or process 500 for the filter apparatus 100, in accordance with one or more embodiments of the disclosure.

In a step 502, an input signal may be received. For example, the filter apparatus 100 may be configured to receive one or more millimeter wavelength frequency signals. For instance, the filter apparatus 100 may include one or more transmission lines 202 configured to provide the input signals received from the input source to the filter apparatus 100.

In a step 504, the input signal may be filtered. For example, the plurality of dielectric layers (e.g., layers 102, 104) and the thin-film metal layers 106 may be configured to allow a predetermined threshold of signal in and reject signal greater than the predetermined threshold without pressure applied to compress layer thicknesses for a nominal response.

In a step 506, a physical thickness of the filter apparatus may be adjusted to tune the rejection notch. For example, the one or more piezoelectric plates 108 may be configured with a control voltage to apply a select amount of pressure to the plurality of dielectric layers to compress. In this regard, the dielectric layer(s) may compress, causing the physical thickness t of the filter apparatus 100 to change. By way of another example, the dielectric layers may be comprised of piezoelectric materials and compress layer thickness by application of a control voltage without piezoelectric plates. By way of another example, the layer thicknesses can be tuned mechanically using compression fitting hardware and specified torque.

In a step 508, the filtered signal may be provided to a signal destination.

It is to be understood that embodiments of the methods disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

Although inventive concepts have been described with reference to the embodiments illustrated in the attached drawing figures, equivalents may be employed and substitutions made herein without departing from the scope of the claims. Components illustrated and described herein are merely examples of a system/device and components that may be used to implement embodiments of the inventive concepts and may be replaced with other devices and components without departing from the scope of the claims. Furthermore, any dimensions, degrees, and/or numerical ranges provided herein are to be understood as non-limiting examples unless otherwise specified in the claims.

What is claimed:

1. A filter apparatus, the filter apparatus comprising:

a plurality of dielectric layers, the plurality of dielectric layers including one or more first dielectric layers formed of a first dielectric material and one or more second dielectric layers formed of a second dielectric material, the second dielectric material of the one or more second dielectric layers being different than the first dielectric material of the one or more first dielectric layers;

one or more thin-film metal layers, the one or more thin-film metal layers arranged between at least one dielectric layer of the plurality of dielectric layers and an additional dielectric layer of the plurality of dielectric layers; and one or more piezoelectric plates, the one or more piezoelectric plates configured to apply a select amount of pressure to the plurality of dielectric layers to cause at least one of the one or more first dielectric layers or the one or more second dielectric layers to compress in response to a control voltage, a physical thickness of the at least one of the one or more first dielectric layers or the one or more second dielectric layers configured to change in response to the applied pressure of the one or more piezoelectric plates.

2. The filter apparatus of claim 1, wherein the first dielectric material of the one or more first dielectric layers is a first piezoelectric material, the first piezoelectric material configured to adjust a physical thickness of the one or more first dielectric layers upon application of a control voltage.

3. The filter apparatus of claim 1, wherein the second dielectric material of the one or more second dielectric layers is a second piezoelectric material, the second piezoelectric material configured to adjust a physical thickness of the one or more second dielectric layers upon application of a control voltage.

4. The filter apparatus of claim 1, wherein the one or more thin-film metal layers are deposited on at least one of the one or more first dielectric layers or the one or more second dielectric layers.

5. The filter apparatus of claim 1, further comprising:

a transmission line, the transmission line configured to provide an input signal to the filter apparatus.

6. The filter apparatus of claim 5, wherein the plurality of dielectric layers include a first set of the plurality of dielectric layers and an additional set of a plurality of dielectric layers, each of the first set of the plurality of dielectric layers and the additional set of the plurality of dielectric layers including the one or more first dielectric layers formed of the first dielectric material and the one or more second dielectric layers formed of the second dielectric material, the second dielectric material of the one or more second dielectric layers being different than the first dielectric material of the one or more first dielectric layers;

the one or more thin-film metal layers including a first set of the one or more thin-film metal layers, the one or more thin-film metal layers arranged between at least one dielectric layer of the first set of the plurality of dielectric layers and an additional dielectric layer of the first set of the plurality of dielectric layers; and the one or more thin-film metal layers including an additional set of the one or more thin-film metal layers, the one or more thin-film metal layers arranged between at least one dielectric layer of the additional set of the plurality of dielectric layers and an additional dielectric layer of the additional set of the plurality of dielectric layers, the first set of the plurality of dielectric layers and the first set of the one or more thin-film metal layers positioned above the transmission line, the additional set of the plurality of dielectric layers and the additional set of the one or more thin-film metal layers positioned below the transmission line.

7. The filter apparatus of claim 5, wherein the plurality of dielectric layers and the one or more thin-film metal layers encircle the transmission line.

8. The filter apparatus of claim 5, wherein the plurality of dielectric layers and the one or more thin-film metal layers are positioned below the transmission line.

9. The filter apparatus of claim 5, wherein the input signal is a millimeter wavelength frequency input signal.

10. A method comprising:

receiving one or more input signals from one or more input sources via one or more signal transmission lines; and filtering the received one or more input signals using a filter apparatus, the filter apparatus comprising:

a plurality of dielectric layers, the plurality of dielectric layers including one or more first dielectric layers formed of a first dielectric material and one or more second dielectric layers formed of a second dielectric material, the second dielectric material of the one or more second dielectric layers being different than the first dielectric material of the one or more first dielectric layers; and one or more thin-film metal layers, the one or more thin-film metal layers arranged between at least one dielectric layer of the plurality of dielectric layers and an additional dielectric layer of the plurality of dielectric layers; and one or more piezoelectric plates, at least one of the plurality of dielectric layers or the one or more thin-film metal layers configured to allow a portion of the received one or more input signals in if the received one or more input signals are less than a predetermined threshold signal, or reject a portion of the received one or more input signals in if the received one or more input signals are greater than the predetermined threshold signal.

11. The method of claim 10, further comprising:

adjusting a physical thickness of the filter apparatus to tune a rejection notch, the one or more piezoelectric plates configured to apply a select amount of pressure to the plurality of dielectric layers to cause at least one of the one or more first dielectric layers or the one or more second dielectric layers to compress in response to a control voltage, a physical thickness of the at least one of the one or more first dielectric layers or the one or more second dielectric layers configured to change in response to the applied pressure of the one or more piezoelectric plates.

12. The method of claim 10, wherein at least of the first dielectric material of the one or more first dielectric layers or the second dielectric material of the one or more second dielectric layers is a piezoelectric material.

13. The method of claim 12, further comprising:

adjusting a physical thickness of the filter apparatus to tune a rejection notch, the piezoelectric material configured to adjust the physical thickness of at least one of the one or more first dielectric layers or the one or more second dielectric layers upon application of a control voltage.

* * * * *